US006219510B1

(12) United States Patent
Ando et al.

(10) Patent No.: US 6,219,510 B1
(45) Date of Patent: Apr. 17, 2001

(54) CHARGING MEMBER EMPLOYING LAYERS FORMED WITH AQUEOUS RESIN

(75) Inventors: Atsutoshi Ando, Kashiwa; Tadashi Onimura, Ueno; Kouichi Suwa, Ushiku; Satoshi Sunahara, Funabashi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/258,295

(22) Filed: Feb. 26, 1999

(30) Foreign Application Priority Data

Feb. 26, 1998 (JP) ..... 10-062196

(51) Int. Cl.[7] ..... G03G 15/02
(52) U.S. Cl. ..... 399/176; 29/895.32
(58) Field of Search ..... 399/168, 174–176; 361/225; 29/895.32; 492/53

(56) References Cited

U.S. PATENT DOCUMENTS 5,089,851 * 2/1992 Tanaka et al. ..... 399/176
5,187,849 * 2/1993 Kobayashi ..... 29/895.32
5,576,805 * 11/1996 Ishihara et al. ..... 399/176
5,761,581 * 6/1998 Nojima ..... 399/174
5,822,658 * 10/1998 Tanaka et al. ..... 399/174
6,020,054 * 2/2000 Masuda et al. ..... 428/319.3

FOREIGN PATENT DOCUMENTS 0 720 069 A2 7/1996 (EP) .
7-209961 * 8/1995 (JP) .
8-211699 * 8/1996 (JP) .
8-272197 * 10/1996 (JP) .

OTHER PUBLICATIONS

Patent Abstracts of Japan, vol. 1998, No. 05, Apr. 30, 1998, (with respect to JP 10 010834 A of Jan. 16, 1998).
Patent Abstracts of Japan, vol. 1997, No. 10, Oct. 31, 1997, (with respect to JP 09 146340 A of Jun. 6, 1997).
Patent Abstracts of Japan, vol. 1995, No. 08, Sep. 29, 1995, (with respect to JP 07 119733 A of May 9, 1995).

* cited by examiner

*Primary Examiner*—Quana M. Grainger
(74) *Attorney, Agent, or Firm*—Fitzpatrick, Cella, Harper & Scinto

(57) ABSTRACT

A charging member includes an electroconductive base for being supplied with a voltage; a first resin layer; a second resin layer; wherein said first and second resin layers are produced by applying and drying paint-like material including resin material dispersed in aqueous material.

18 Claims, 8 Drawing Sheets

CHARGING MEMBER EMPLOYING LAYERS FORMED WITH AQUEOUS RESIN

FIELD OF THE INVENTION AND RELATED ART

The present invention relates to a charging member, which is employed in an image forming apparatus such as a copying machine or a printer, and is placed in contact with the image bearing member of the image forming apparatus to charge the image bearing member.

In a conventional electrophotographic image forming apparatus, a corona based charging device has been widely used as a charging apparatus for giving primary charge to a photosensitive member as an image bearing member. In order to charge an object with the use of a corona based charging device, an object to be charged is exposed to corona discharge induced by applying high voltage to a piece of wire, which the device comprises.

In recent years, development of a contact type charging apparatus has been in progress. In order to charge an object, with the use of a contact type charging apparatus, a charging member is placed in contact with an object to be charged, and then, voltage is applied to the charging member. A contact type charging process has some advantages over a corona based charging process, which is a noncontact type charging process. For example, the voltage required in a contact type charging process to charge the surface of an object to a predetermined potential level is lower than that required by a corona based charging process, and also the amount of ozone generated while the object is charged in the former is smaller than that in the latter. Among the contact type charging systems, a roller based charging system, which employs an electrically conductive roller, is more desirable, particularly in terms of reliability, than the other contact type charging systems. Thus, recently, a roller based charging system has come to be widely used.

Illustrated in FIGS. 14 and 15 is an example of a charge roller as a charging member in a conventional electrophotographic image forming apparatus.

In the drawings, a charging member 1 comprises an electrically conductive shaft 2, an elastic layer 3, a resistance layer 4, and a protection layer 5. The electrically conductive layer 2 doubles as a power supply electrode. The elastic layer 3 is formed on solid rubber, or resin, for example, styrene-butadiene rubber (SBR), isopropylene rubber, silicone rubber, or the like, in which electrically conductive material such as carbon black or metallic powder is dispersed to make the elastic layer electrically conductive.

The resistance layer 4 is a layer provided for giving a proper amount of electrical resistance to the charging member 1. As for the material for the resistance layer 4, acrylic resin, hydrin rubber, urethane, silicone rubber, and the like can be listed. Into these materials, a proper amount of electrically conductive particles, for example, carbon black powder, metallic powder and the like, is dispersed to give these materials a proper amount of electrical conductivity.

The protection layer 5 is provided to give the charging member 1 desirable surface properties, and to prevent the surface of the image bearing member from being contaminated with the resistance layer material. As for the materials for the protection layer 5, synthetic resin such acrylic resin, N-methoxymethylnylon, acrylic denatured urethane, and the like can be listed.

The protection layer 5 must not disturb the uniform electrical resistance given to the charging member 1 by the resistance layer 4. However, making the protection layer 5 conductive is liable to allow electrical charge to leak, if low resistance areas such as pinholes are created in the photosensitive member surface. Thus, it is necessary that the protection layer 5 has as much electrical resistance as the resistance layer 4. In other words, the protection layer 5 must be formed of a material which is uniform in electrical resistance, and in which the aforementioned electrically conductive particles can be desirably dispersed.

Another reason why a charging member is provided with the protection layer 5 which gives the charging member the desirable surface properties is to prevent the electrical resistance of the charging member from becoming uneven through usage. For this objective, the surface energy of the protection layer 5 is desired to be as small as possible. Thus, it has been considered to disperse particles of fluorinated substance (for example, tetrafluoroethylene powder) into the material for the protection layer 5.

Presently, in order to form the protection layer 5, which satisfies the above described rigid requirements, that is, a protection layer 5 which is excellent in surface properties, and is uniform in electrical resistance, a solution created by mixing the aforementioned resin, electrically conductive particles, and fluorinated substance, and the like, into organic solvent is coated on the resistance layer 4, and then, is air-dried at a temperature of no more than 120° C.

It has been known that if the coated layer of the above described solution is air-dried at a temperature of no less than 120° C., the coated layer wrinkles or cracks as it dries, adversely affecting the surface properties of a charging member. Further, if a high temperature is used for drying the coated layers of a charging member, the underlying layers are liable to deform, which also adversely affects the surface properties of a charging member. Therefore, it is desired that relatively low temperature is used also when forming the resistance layer.

Recently, charging members of a new type have been devised. In the cases of these charging members, aqueous resin is employed as the material for the resistance layer 4 and the protection layer 5, instead of the organic solvent soluble resin used to form charging members of the conventional type. Water-soluble resin is used for the following reason. That is, if organic solvent soluble resin is employed as the material for the resistance layer 4 formed on the elastic layer 3. The elastic layer 3, which is formed of foamed material, is caused to swell by the organic solvent, which makes it difficult to produce a charging member with a smooth surface. Thus, aqueous resin is employed to prevent such swelling of the elastic layer 3 caused by the organic solvent.

Employment of aqueous resin enjoys additional merits: it eliminates the need for organic solvent management, and therefore, it is advantageous in terms of cost; and using no organic solvent eliminates the concern about environmental contamination.

However, employment of aqueous material has its own problems. For example, it has been known that if the temperature and humidity of the environment in which a aqueous material based charging member 1 is used become very high, the charging member 1 is liable to adhere to an image bearing member, and if the image bearing member is driven under these conditions, the protection layer 5 is liable to be peeled away from the charging member 1. Hereinafter, this phenomenon will be simply called "peeling".

It has been thought that the peeling occurs through the following mechanism.

When the material for the protection layer is aqueous, the protection layer 5 absorbs humidity as the temperature and humidity of the environment in which a charging member 1 is used increase. As a result, the protection layer 5, that is, the surface layer of the charging member, adheres to the surface of an image bearing member.

It has also been known that If the surfaces of a charging member 1 and an image bearing member are wet with water, in particular, the dew formed on the surfaces of the two members through condensation, come in contact with each other, the adhesion between the two surfaces becomes firmer, because the water is confined in the nip formed by the two surfaces, and the presence of the water between the two surfaces makes it easier for the two surfaces to adhere to each other more firmly than without the presence of water.

Further, if the protection layer 5 and the resistance layer 4 are different in swelling ratio, force is generated at the interface between the protection layer 5 and the resistance layer 4 in the direction to shear the protection layer 5 from the resistance layer 4. This shearing force weakens the film adhesion between the resistance layer 4 and the protection layer 5 which was present immediately after the manufacture of the charging member 1. As a result, if the protection layer 5 adheres to the image bearing member, the protection layer 5 is liable to be peeled away from the resistance layer 4 of the charging member 1, that is, to remain adhered to the image bearing member. In other words, peeling is liable to occur when the two layers 5 and 4 are different in swelling ratio.

The magnitude of the shearing force which occurs at the interface between the protection layer 5 and the resistance layer 4 is proportional to the amount of the difference in swelling ratio between the protection layer 5 and the resistance layer 4 at the time when the condition of the environment in which the charging member 1 is operated has just changed from the normal to a high temperature-high humidity condition. More specifically, if the swelling ratio of the resistance layer 4 is extremely small, a large amount of shearing force is generated even if the swelling ratio of the protection layer 5 is rendered relatively small.

If peeling occurs, a toner image cannot be satisfactorily formed across the portions of the image bearing member surface, to which the material of the protection layer 5 of the charging member 1 had adhered. In other words, the toner image appears abnormal across the areas correspondent to these portions of the image bearing member.

Further, it peeling occurs, the portions of the charging member 1, from which the protection layer 5 was peeled away, becomes different in electrical resistance from the other portions of the charging member 1. Therefore, an image bearing member is nonuniformly charged, and this nonuniformity appears as abnormality in a finished image.

Further, if peeling occurs, and the portions of a charging member, from which the protection layer 5 was peeled away, are left in contact with an image bearing member, the peripheral surface of the image bearing member is liable to be further contaminated.

SUMMARY OF THE INVENTION

The primary object of the present invention is to provide a charging member which comprises functional layers formed of aqueous resin, and an image forming apparatus which employs such a charging member.

Another object of the present invention is to provide a charging member, the surface layer of which does not peel off even if the surface layer swells by absorbing the moisture in the air, and an image forming apparatus which employs such a charging member.

Another object of the present invention is to provide a charging member, which comprises: an electrically conductive base member, to which voltage is applied; the first resin layer forced by coating said base member with a layer of solution made of water and aqueous resin, and then, drying the layer of solution; and the second resin layer, which is formed by coating the first resin layer with a different solution also made of water and aqueous resin, and then, drying the layer of the different solution.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, preferable embodiments of the present invention will be described with reference to the drawings.

Embodiment 1

Figure 1:
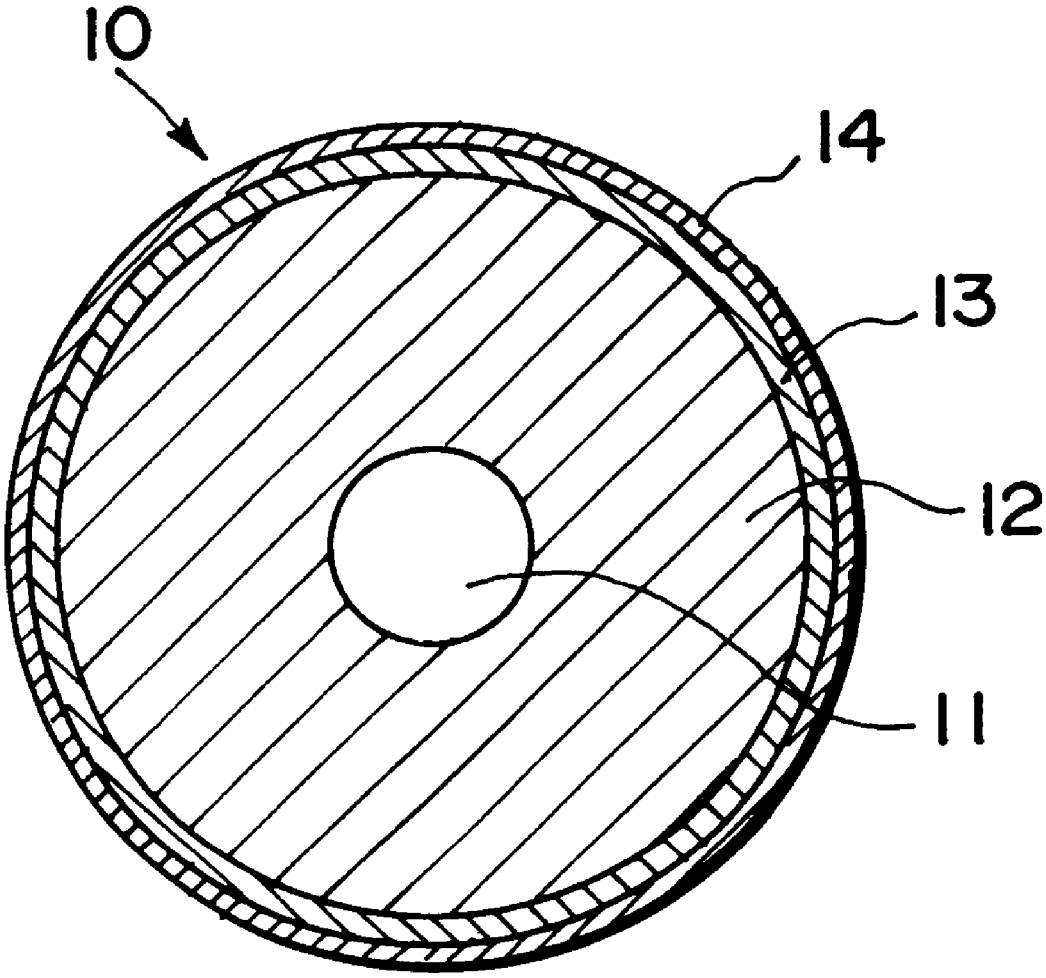
FIG. 1 is a sectional view of a charge roller as the first embodiment of the present invention.

FIG. 1 is a sectional view of the charging member as the first embodiment of the present invention. This charging member is in the form of a roller; it is constituted of a charge roller.

In FIG. 1, a referential character 10 designates an electrically conductive supporting member, which is in the form of a shaft, and doubles as a power supply electrode. The supporting member 10 is formed of plastic or metallic material.

The electrically conductive supporting member is covered with an elastic layer 12, a resistance layer 13, and a protection layer 14, in the listed order. The elastic layer 12 is electrically conductive. The resistance layer 13 is larger in electrical resistance than the elastic layer 12. The protective layer 14 is larger in electrical resistance than the resistance layer 13. The diameter of the supporting member 11 is approximately 14 mm.

In this embodiment, foamed urethane (urethane sponge) is used as the material for the elastic layer 12. The foam contains metallic oxide, which was mixed in the urethane to give electrical conductivity to the material.

As for the formation of the resistance layer 13, carbon particles are dispersed into a mixture of aqueous solution of aqueous acrylic resin and an aqueous dispersion of butyral, by stirring. Then, an approximately 300 $\mu$m thick layer of the mixture is formed on the peripheral surface of the supporting member 11 by dipping. Then, the layer of the mixture is dried by leaving it for five to six hours in an ambience with a temperature of 100° C.

As for the formation of the protection layer 14, aqueous solution of aqueous fluorinated resin (polytetrafluoroethylene), in which carbon particles have been dispersed, aqueous emulsion of vinylidene, and aqueous dispersion of butyral resin, are mixed. Then, an approximately 10 $\mu$m thick layer of the mixture is formed on the resistance layer 13 by dipping. Then, the layer of the mixture is dried for five to six hours in an ambience with a temperature of 100° C.

The temperature at which the protection layer and resistance layer are dried is desired to be no more than 120° C.

As is evident from the above description, according to the present invention, both the protection layer and resistance layer are formed with the use of the above described materials and manufacturing method, that is, both the layers are formed by coating the aqueous solution, or dispersion, of wafer-soluble resins on the supporting member, and then drying the layer of the coated aqueous solution, or dispersion. Therefore, the difference in swelling ratio between the protection layer and the resistance layer is smaller than that of a conventional charging member.

Next, experiments in which the swelling ratio of the protection layer and resistance layer were varied will be described with reference to the drawings.

Experiment 1

Figure 2:
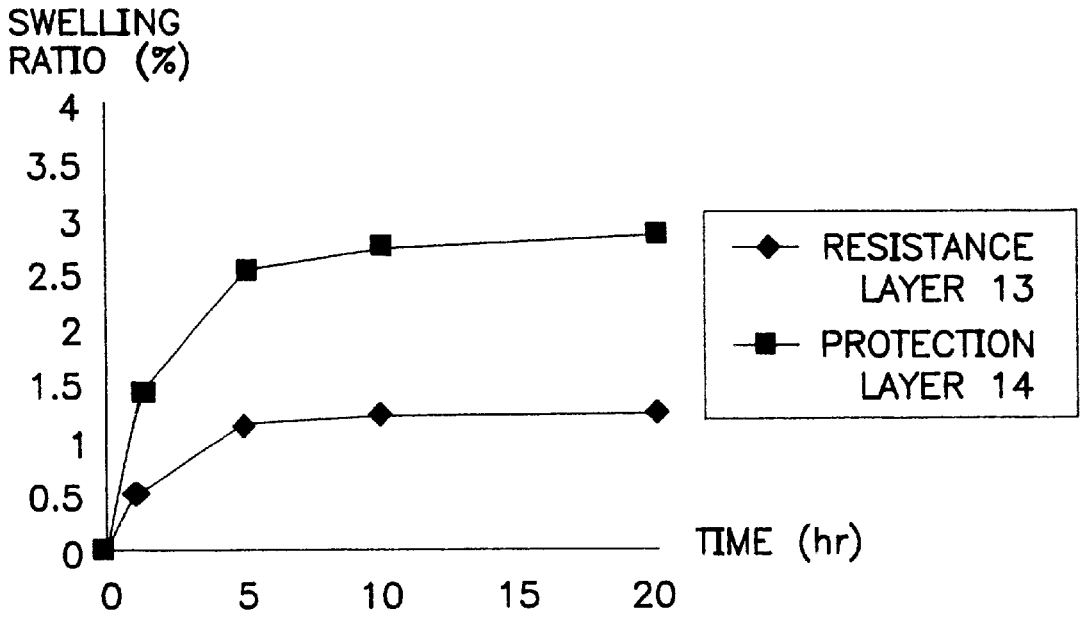
FIG. 2 is a graph which shows the changes of the swelling ratios of the resistance layer and protection layer of the charge roller as the first embodiment of the present invention.

FIG. 2 shows the swelling ratios of the materials used for forming the resistance layer 13 and protection layer 14 of the first version of the charge roller 10 in accordance with the present invention.

Here, "swelling ratio" means ratio in volumetric change which occurs to a pure material when the temperature and relative humidity of the ambience of the material changes from 23° C. and 50% to 40° C. and 95%, respectively. In other words, the graph means that a material with a larger swelling ratio swelled more than a material with a smaller swelling ratio, when they absorbed moisture.

As shown in FIG. 2, the swelling ratios of both the resistance layer 13 and protection layer 14 began to increase as soon as the ambience changed and reached saturation levels after 5 to 20 hours.

According to FIG. 2, the maximum swelling ratio of the resistance lever 13 was approximately 1.2%, whereas the maximum swelling ratio of the protection layer 14 was approximately 2.8%. Thus, the difference in swelling ratio between the two layers was approximately 1.6%.

Figure 3:
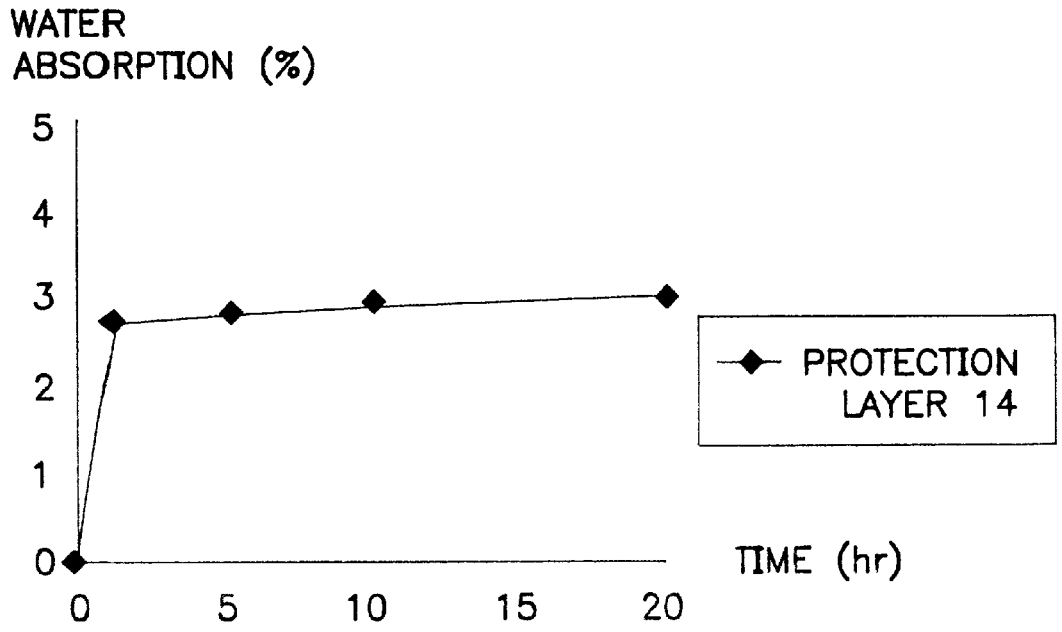
FIG. 3 is a graph which shows the changes of the swelling ratios of the resistance layer and protection layer of the charge roller tested in the first experiment.

FIG. 3 shows the water absorption of the protection layer 14 of the charge roller 10 in this embodiment.

Here, "water absorption" means the ratio of the change in weight which occurs to a pure material for the protection layer 14 as the material is moved from an environment in which the temperature and humidity are 23° C. and 50%, respectively, to an environment in which the temperature and humidity are 40° C. and 95%, respectively. In other words, the graph means that the larger the water absorption of a material in FIG. 3, the more water the material absorbed.

As shown in FIG. 3, the water absorption began to increase immediately after the material was moved into the aforementioned high temperature-high humidity environment, and reached the saturation level after 5 to 20 hours.

According to FIG. 3, the maximum water absorption of the protection layer 14 was approximately 3.0%.

Figure 4:
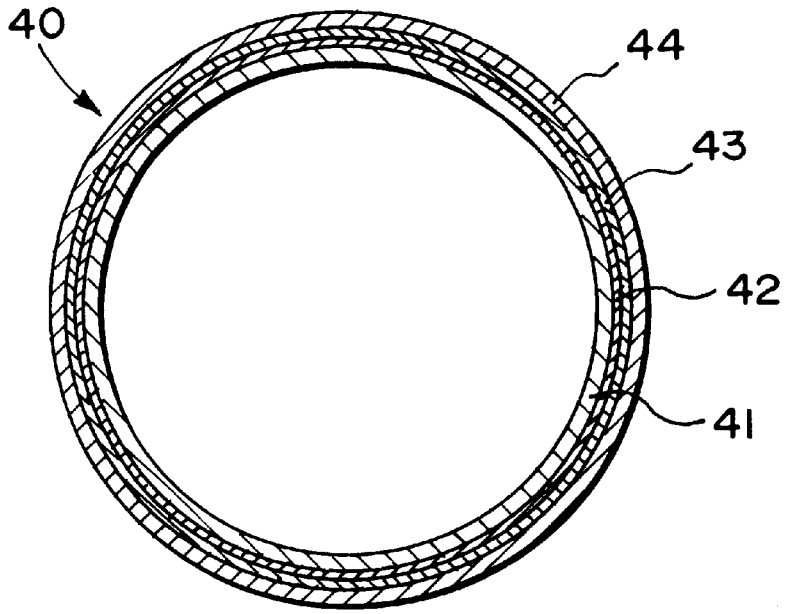
FIG. 4 is a sectional view of a photosensitive drum.

FIG. 4 is a sectional view of the photosensitive drum, that is, an image bearing member, employed in the experiments.

The photosensitive drum 40 was an organic photosensitive member. It comprised an aluminum cylinder 41 with a diameter of 30 mm, an undercoat layer 42, a charge generation layer 43, and a charge transfer layer 44. These layers were coated on the peripheral surface of the aluminum cylinder 41 in the listed order. The charge transfer layer 44 was formed of bisphenol-2 type polycarbonate.

Figure 5:
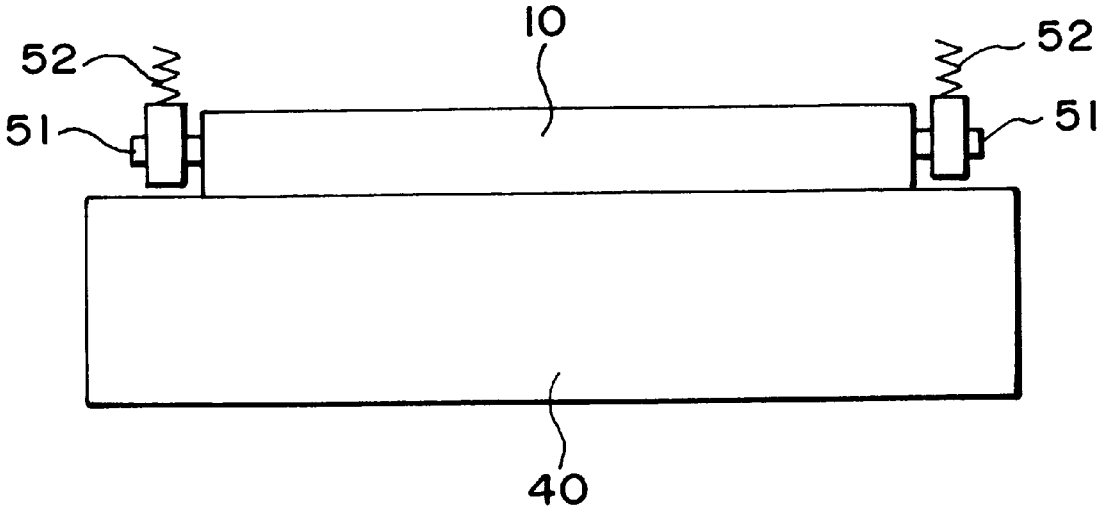
FIG. 5 is a schematic drawing which shows the state of contact between a charge roller and a photosensitive drum.

The charge roller 10 was placed in contact with the photosensitive drum 40 as illustrated in FIG. 5. More specifically, pressure was applied to the charge roller 10 with the use of two springs 52 attached to the longitudinal end portions, that is, the power supply electrode portions 51, of the supporting member of the charge roller 10. Each spring 52 generated a pressure of 700 g, and therefore, a total pressure of 1400 g was applied to the charge roller 10.

Then, the charge roller 10 and the photosensitive drum 40 were left, being kept in contact with each other as described above, in an environment in which the temperature and relative humidity were 40° C. and 95%, respectively, for a period of one month.

Even after one month, peeling did not occur, and also, no irregularities could be detected in the images formed with the use of this first version of the described charge roller 10, and the above described photosensitive drum 40.

In another test, first, the charge roller 10 and the photosensitive drum 40 were left undisturbed until dew was formed on their peripheral surfaces through condensation. Then, the surfaces of the two members 10 and 40 wet with the dew were placed in contact with each other, and left in an environment in which the temperature and humidity were 32.5° C. and 80%, respectively, for a period of two weeks. After two weeks, the protection layer 14 of the charge roller, and the photosensitive drum 40, had adhered to each other, but could be easily separated, without causing peeling.

Experiment 2

The charging member tested in this experiment was also in the form of a roller as was the first version tested in the first experiment.

This version, or the second version, of the charge roller in accordance with the present invention was substantially the same as the first version in the first experiment: the resistance layer 13 was the same as the charger roller in the first experiment, but the protection layer 14 was slightly different in material from the one in the first experiment. More specifically, the amount of butyral in the material for the protection layer 14 of this version was 1.5 times the amount in the first experiment. The other aspects of this version of charge roller were the same as those of the first version.

Figure 6:
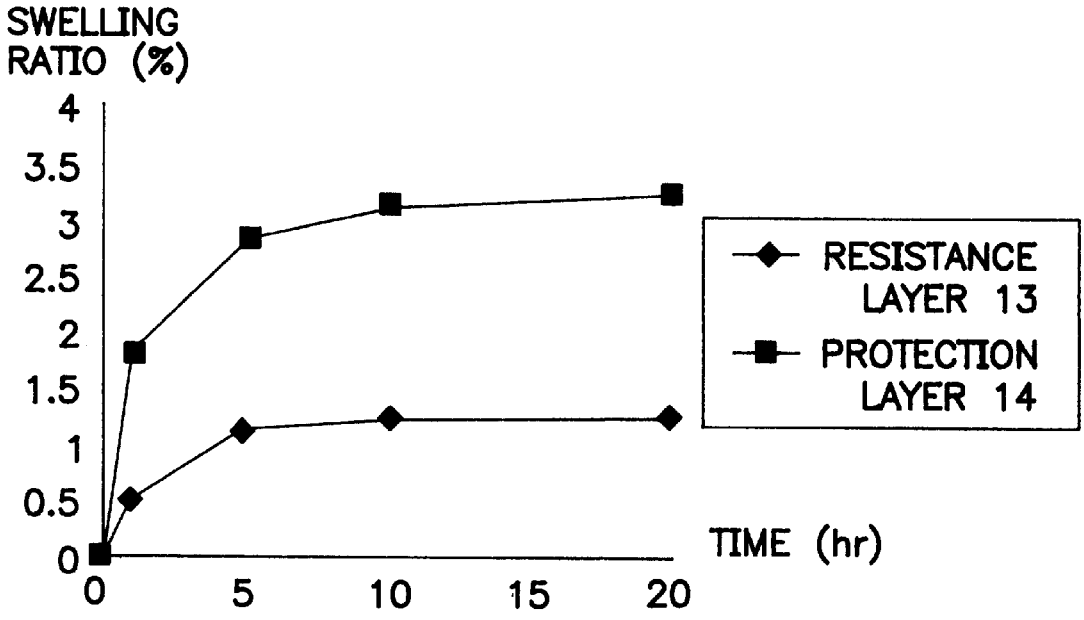
FIG. 6 is a graph which shows the changes of the swelling ratio of the resistance layer and protection layer of the charge roller tested in the second experiment.

FIG. 6 is a graph which shows the changes of the swelling ratios of the resistance layer 13 and protection layer 14 of this second version.

As is evident from the graph, the swelling ratios of the resistance layer 13 and protection layer 14 were 1.2% and 3.2%, respectively. Thus, the difference in swelling ratio between the two layers was 2.0%.

This charge roller 10 was placed in contact with the photosensitive drum 40 in the same manner as the one in the first experiment, and then, was left undisturbed in an environment in which the temperature and humidity were 40° C. and 95%, respectively, for a period of one month. After one month, the charge roller 10 had adhered to the photosensitive drum 40. But, the photosensitive drum 40 could be easily rotated by hand, and the images formed with the use of the charge roller 10 and photosensitive member 40 showed no sign of particular irregularities.

In another test, first, the charge roller 10 and the photosensitive drum 40 were left undisturbed until dew was formed on their peripheral surfaces through condensation. Then, the surfaces of the two members 10 and 40 wet with the dew were placed in contact with each other, and left in an environment in which the temperature and humidity were 32.5° C. and 80%, respectively, for a period of two weeks. After two weeks, the protection layer 14 of the charge roller, and the photosensitive drum 40, had firmly adhered to each other but the photosensitive drum 40 could be easily rotated, without causing peeling.

Experiment 3

Also in this experiment, a charging member in the form of a roller similar to the one in the first experiment was used. The resistance layer 13 of this version, or the third version, of the charge roller was the same as the charge roller in the first experiment.

The protection layer 14 was substantially the same as the one in the first experiment, except for its material. More specifically, the amount of butyral in the material for the protection layer 14 in this experiment was twice the amount in the first experiment. The other aspects of the charge roller were the same as those in the first experiment.

Figure 7:
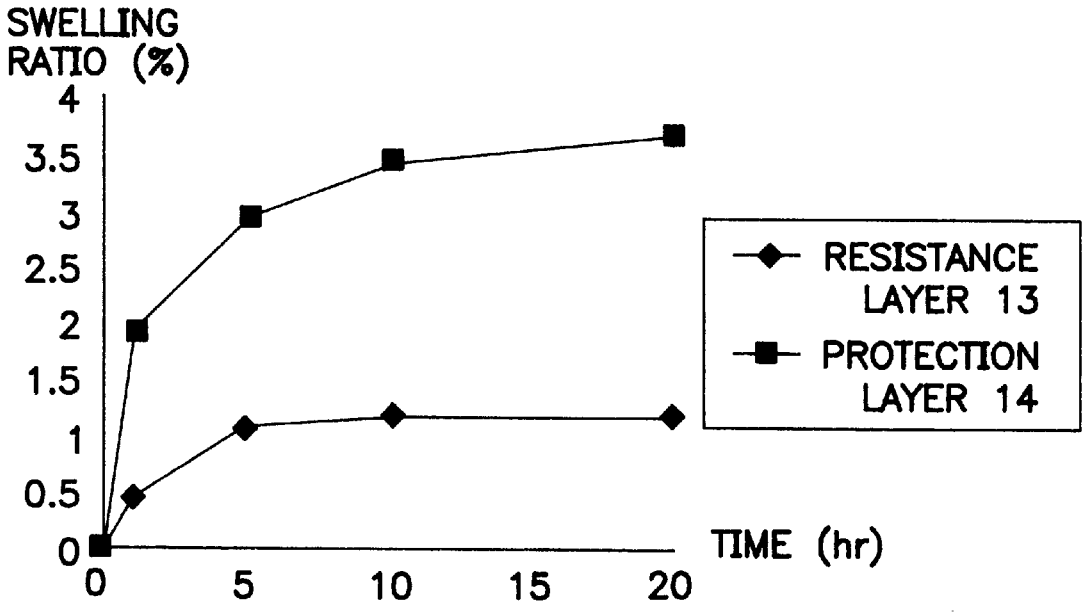
FIG. 7 is a graph which shows the changes of the swelling ration of the resistance layer and protection layer of the charge roller test in the third experiment.

FIG. 7 is a graph which shows the changes in the swelling ratios of the resistance layer 13 and the protection layer 14 of this version of the charge roller.

As is evident from the graph, the swelling ratios of the resistance layer 13 and protection layer 14 were 1.2% and 3.7%. respectively. Thus, the difference in swelling ratio between the two layers was 2.5%.

This charge roller 10 was placed in contact with the photosensitive drum 40 in the same manner as the one in the first experiment, and then, was left undisturbed in an environment in which the temperature and humidity were 40° C. and 95%, respectively, for a period of one month. After one month, the charge roller 10 had adhered to the photosensitive drum 40. But, the photosensitive drum 40 could be easily rotated by hand, and the images formed with the use of the charge roller 10 and photosensitive member 40 showed no sign of particular irregularities.

In another test, first, the charge roller 10 and the photosensitive drum 40 were left undisturbed until dew was formed on the peripheral surfaces of the two members 10 and 40 through condensation. Then, the surfaces of the two members 10 and 40 wet with the dew were placed in contact with each other, and left undisturbed in an environment in which the temperature and humidity were 32.5° C. and 80%, respectively, for a period of two weeks. After two weeks, the protection layer 14 of the charge roller, and the photosensitive drum 40, had firmly adhered to each other, but the photosensitive drum 40 could be rotated. However, after the manual rotation of the photosensitive drum 40, it was found that a small portion of the protection layer had been peeled away from the charge roller, at the areas correspondent to the longitudinal end portions of the photosensitive drum 40. The images formed with the use of the charge roller 10 and the photosensitive drum 40 showed no sign of irregularities, and also there occurred no problem related to peeling, since the locations of peeling were outside the image formation range.

Experiment 4

Also in this experiment, a charging member in the form of a roller similar to the one in the first experiment was test. The resistance layer 13 of this version of the charge roller was the same as the one in the first experiment in terms of material and drying condition. However, the protection layer 14 of this version was rendered different from the one in the first experiment More specifically, the amount of butyral resin in the material for the protection layer 14 in this experiment was twice the amount in the first experiment, and the drying temperature was 75° C.

Figure 8:
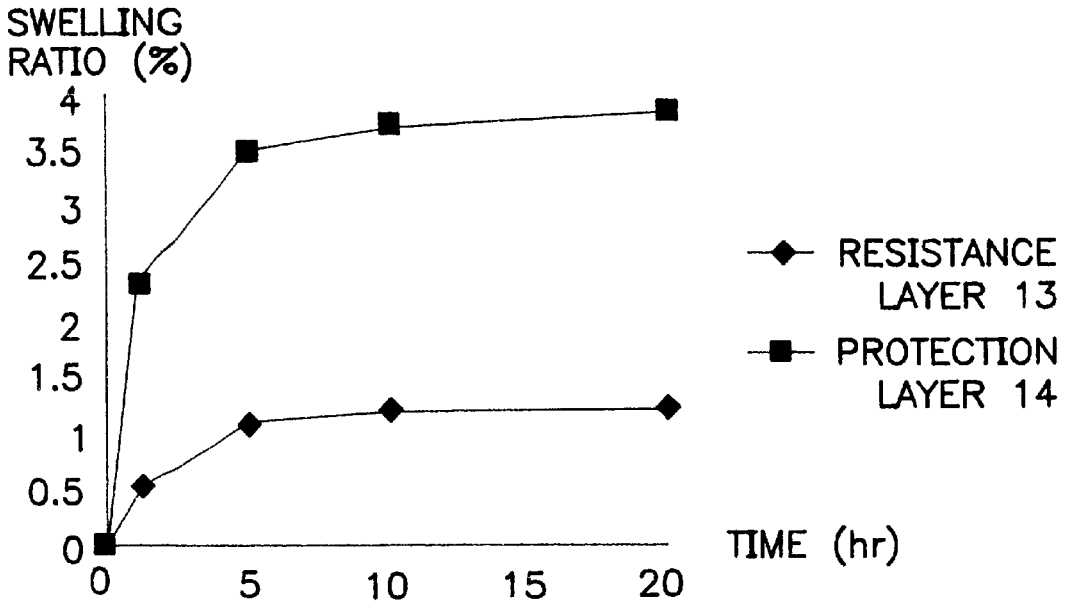
FIG. 8 is a graph which shows the swelling ratio of the resistance layer and protection layer of the charge roller in the fourth experiment.
Figure 9:
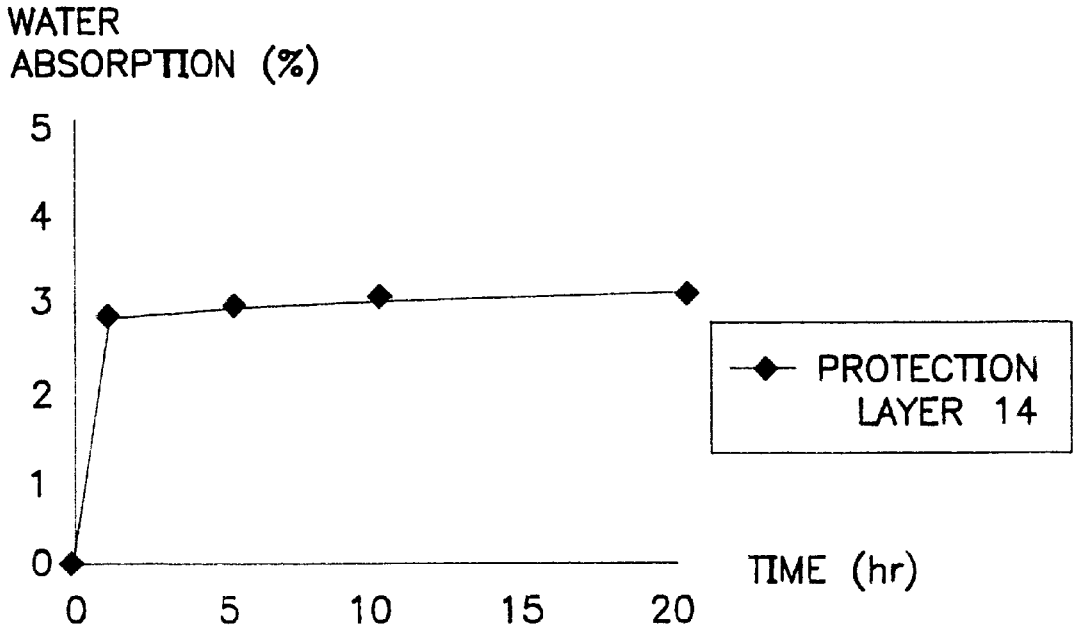
FIG. 9 is a graph which shows the change of the water absorption of the protection layer of the charge roller in the fourth experiment.

FIGS. 8 and 9 show the changes in the swelling ratios and water absorption, respectively, of the protection layer 14 of this version of the charge roller.

As is evident from the graphs, the maximum swelling ratios and maximum water absorption, respectively, of the protection layer 14 were 3.8% and 3.7%, respectively. Thus, the difference in swelling ratio between the materials for the two layers was 2.6%.

This charge roller 10 was placed in contact with the photosensitive drum 40 in the same manner as the one in the first experiment, and then, was left undisturbed in an environment in which the temperature and humidity were 40° C. and 95%, respectively, for a period of one month. After one month, peeling had not occurred, but the charge roller 10 had firmly adhered to the photosensitive drum 40, making it rather difficult to manually rotate the photosensitive drum 40.

In another test, first, the charge roller 10 and the photosensitive drum 40 were left undisturbed until dew is formed on the peripheral surfaces of the two members 10 and 40 through condensation. Then, the surfaces of the two members 10 and 40 wet with the dew were placed in contact with each other, and left undisturbed in an environment in which the temperature and humidity were 32.5° C. and 80%, respectively, for a period of two weeks. After two weeks, peeling had occurred, although the areas to which peeling had occurred were very small and located at the longitudinal end portions of the charge roller. When the charge roller 10 and photosensitive member 40 were used to form an image, the areas of the photosensitive drum 40 to which the ingredients of the protection layer 14 had adhered failed to carry out the image forming process. As a result, the image produced with the use of these components suffered from white spots. This phenomenon occurred because the swelling ratio of the protection layer 14 became greater than that of the resistance layer 13, and therefore, shearing force was generated at the interface between the resistance layer 13 and the protection layer 14, making it easier for the protection layer 14 to peel away from the resistance layer 13.

Experiment 5

Also in this experiment, a charging member in the form of a roller similar to the one in the first experiment was used. However, the resistance layer 13 of this version of the charge roller was different from the one in the first experiment in terms of material: unlike the material for the resistance layer 13 in the first experiment, the material for the resistance layer 13 of this version of the charge roller did not contain butyral resin. The protection layer 14 was the same as the one in the first experiment.

Figure 10:
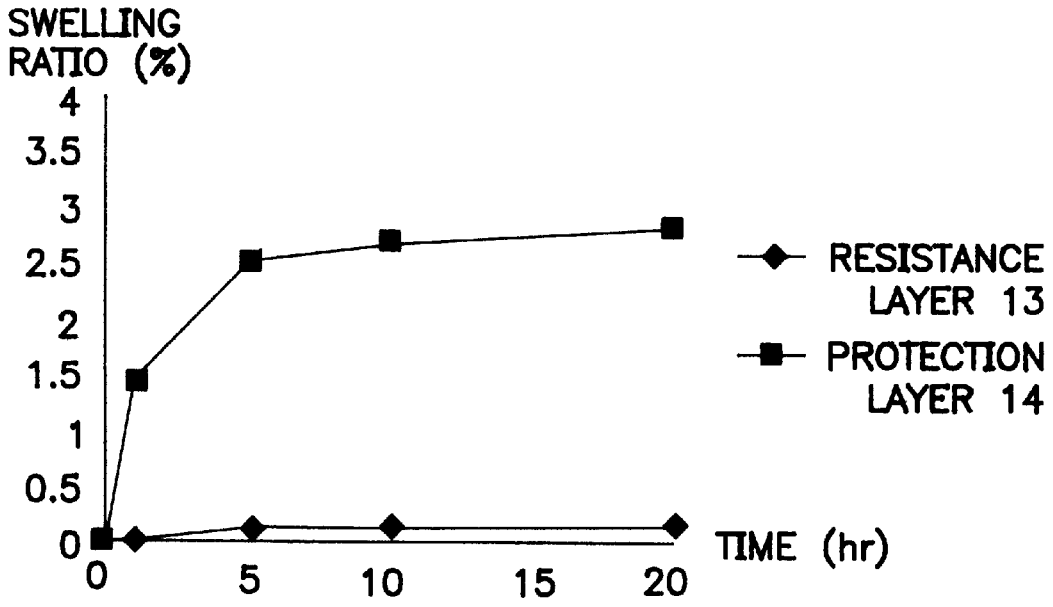
FIG. 10 is a graph which shows the charges of the resistance layer and protection layer of the charge roller in the fifth experiment.
Figure 11:
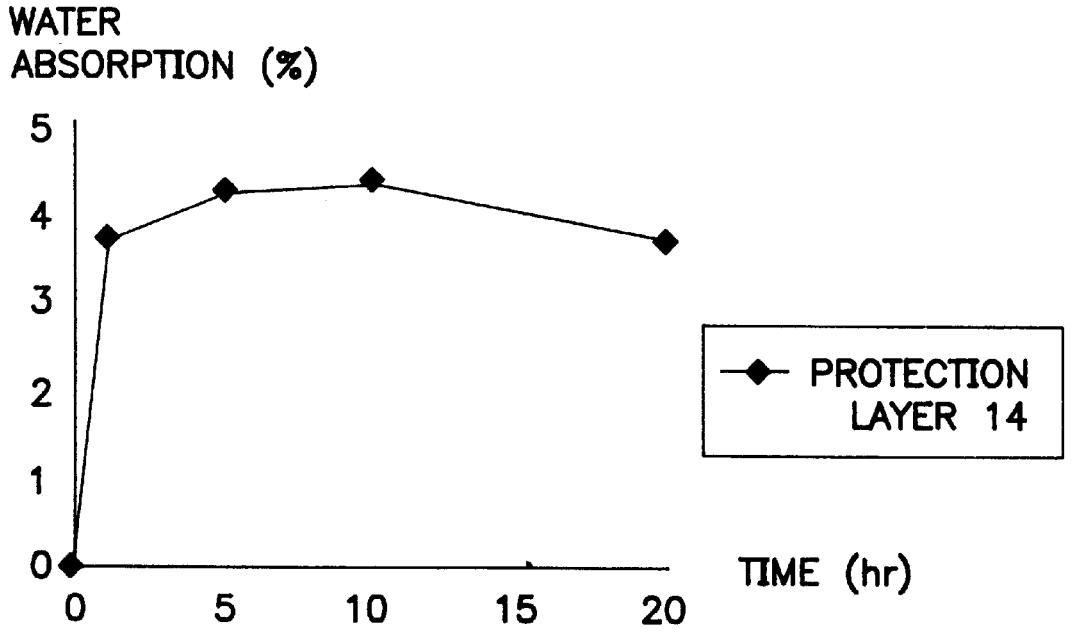
FIG. 11 is a graph which shows the change of the water absorption of the protection layer of the charge roller in the fifth experiment.

FIGS. 10 and 11 show the changes in the swelling ratios and water absorption, respectively, of the protection layer 14 of this version of the charge roller.

According to these graphs, the maximum swelling ratio of the resistance layer of this version of the charging member was 0.1%, and the maximum swelling ratio and water absorption of the material for the protection layer 14 were approximately 2.8% and 4.5%, respectively. Thus, the difference in swelling ratio between the materials for the resistance layer 13 and protection layers was approximately 2.7%.

This charge roller 10 was placed in contact with the photosensitive drum 40 in the same manner as the one in the first experiment, and then, was left undisturbed in an environment in which the temperature and humidity were 40° C. and 95%, respectively, for a period of one month. After one month, the charge roller 10 and photosensitive drum 40 had firmly adhered to each other. When they were forcefully separated, a strip of the protection layer 14 of the charge roller 10, that is, the portion which was in the nip formed by the charge roller 10 and the photosensitive member 40, was ripped away by the photosensitive drum 40, and remained adhered to the photosensitive drum 40. This phenomenon occurred because the difference in swelling ratio between the protection layer 14 and resistance layer 13 of this version of the charge roller was large, and therefore, a powerful shearing force was generated at the interface between the resistance layer 13 and the protection layer 14, weakening thereby the adhesion between the resistance layer 13 and the protection layer 14. As a result, when the resistance layer 13 and protection layer 14 which had firmly adhered to each other at the contact nip were manually rotated, the protection layer 14 was peeled away from the charge roller 10.

The above described condensation test was eliminated since the protection layer 14 had already peeled away without condensation.

The results of the first to fifth experiments are summarized in the following table.

TABLE

| | DIFFERENCE IN SWELLING RATIO BETWEEN RESISTANCE LAYER & PROTECTION LATER | KEPT IN 40° C., 95% FOR ONE MONTH | KEPT IN 32.5° C., 80% FOR TWO WEEKS |
|---|---|---|---|
| EMB. 1 | 1.2% | Y | Y |
| 2 | 2.0% | Y | Y |
| 3 | 2.5% | Y | F |
| EXP. 4 | 2.6% | Y | N |
| 5 | 2.7% | N | — |

Y: NO PROBLEM
F: PRACTICAL
N: UNPRACTICAL

As is evident from the test results given above, as long as the difference in swelling ratio between the materials for the resistance layer 13 and protection layer 14 is no more than 2.5%, it is possible to produce a charge roller which does not present any problem in practical terms.

As described above, the difference in swelling ratio between the resistance layer and protection layer of a charge roller can be reduced by using aqueous resin as the material for the resistance layer, as well as the protection layer. This difference in swelling ratio is desired to be no more than 2.5%.

Embodiment 2

Next, another embodiment of the present invention will be described.

This embodiment of the present invention as a charging member is characterized in that it is in the form of a blade, although the other aspect of the charging member and the materials for the charging member, are the same as those in the first embodiment.

Figure 12:
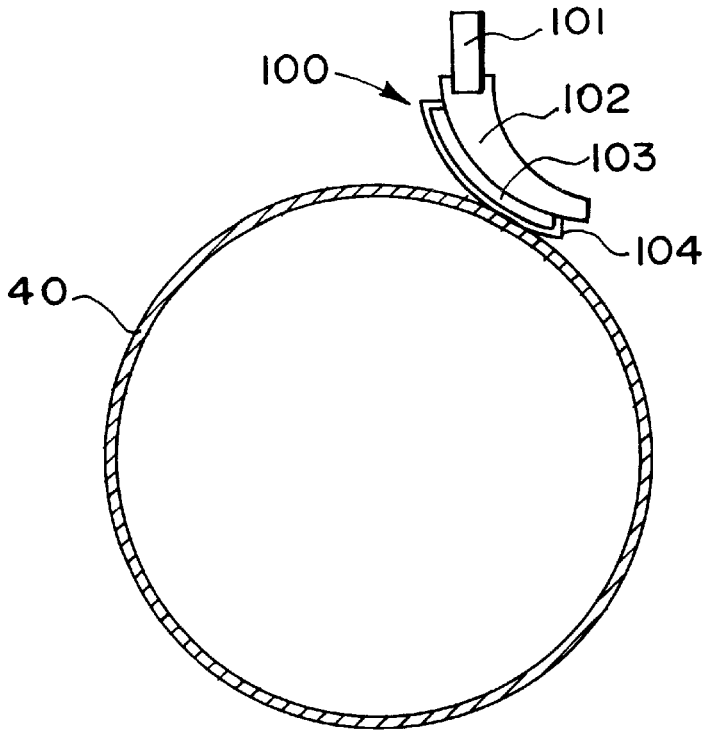
FIG. 12 is a sectional view of a charging blade as the second embodiment of the present invention.

More specifically, referring to FIG. 12, this embodiment of the present invention; that is, the charge blade 100, comprises an electrically conductive supporting member 101, a base member 102, a resistance layer 103, and a protection layer 104. The electrically conductive supporting member 101 is farmed of metallic or plastic material, and doubles as a power supply electrode. The base member 102 is formed of urethane foam. The materials for the resistance layer 103 and protection layer 104, and the conditions under which they are formed, are the same as the materials and formative conditions for the resistance layer 13 and protection layer 14 of the first embodiment of the present invention, which was in the form a roller.

The charge blade 100 is fixed to the charging apparatus frame at both of the longitudinal ends of the supporting member 101, with the use of unillustrating fixing members. This arrangement assures that the charge blade 100 is pressed upon a photosensitive drum 40, forming a contact nip with a proper width.

More specifically, the position of the charge blade 100 is adjusted so that a linear pressure of 43 g/cm is generated at the interface between the charge blade and the photosensitive drum 40.

This charge blade 100 was placed in contact with the photosensitive drum 40 in the same manner as the charge roller 10, that is, the first embodiment of the present invention as a charging member, and then, was left undisturbed in on environment in which the temperature and relative humidity were 40° C. and 95%, respectively, for a period of one month. After one month, the charge blade 100 and photosensitive drum 40 had not adhered to each other, and images formed with the use of these components showed no sign of irregularity.

In another test, both the charge blade 100 and photosensitive drum 40 were left undisturbed until their peripheral surfaces were covered with dew resulting from condensation, and the peripheral surfaces of the charge blade 100 and photosensitive drum 40 wet with the dew were placed in contact with each other. Then, they were left undisturbed in an environment in which the temperature and humidity were 32.5° C. and 80%, respectively, for a period of two weeks. After two weeks, a low degree of adhesion and occurred between the charge blade 100 and photosensitive drum 40, but peeling had not occurred. Also, an image formed with the use of these components showed no sign of any specific irregularity.

Embodiment 3

Next, another embodiment of the present invention will be described.

This embodiment of the present invention is in the form of a process cartridge for an image forming apparatus, which is characterized in that it comprises a charging member in accordance with the present invention, along with other functional components, for example, a photosensitive drum, a cleaning apparatus, a developing apparatus: they are assembled into the housing of a process cartridge.

Figure 13:
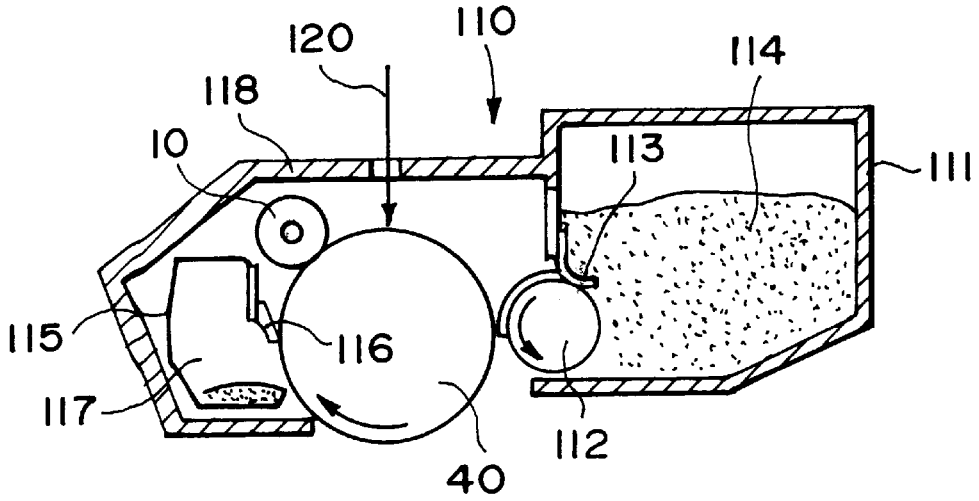
FIG. 13 is a schematic cross-section of a process cartridge as the third embodiment of the present invention.
Figure 14:
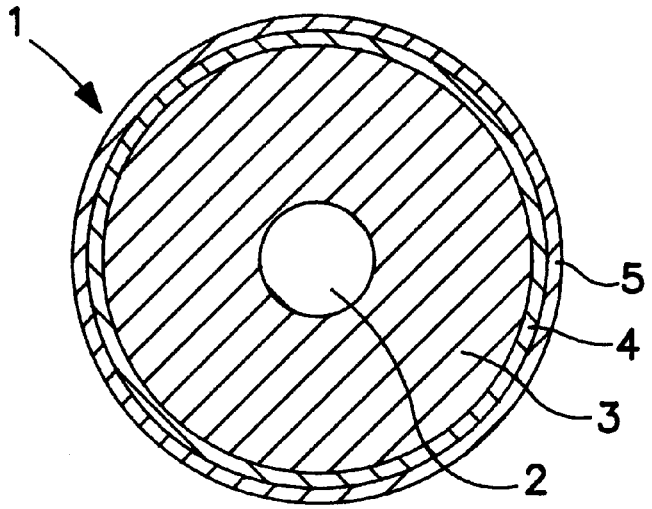
FIG. 14 PRIOR ART
FIG. 14 is a sectional view of a conventional charge roller.
Figure 15:
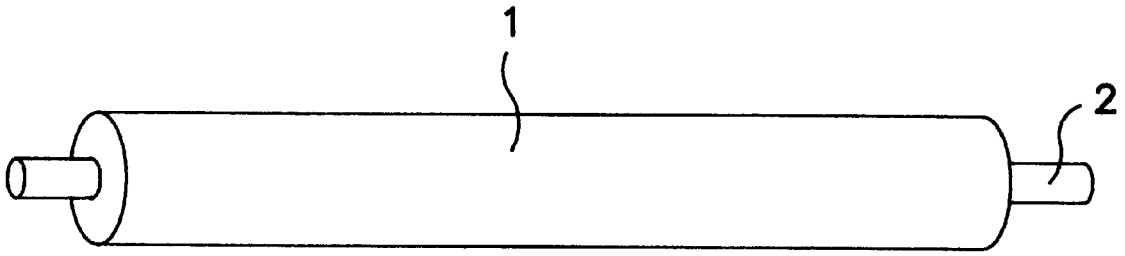
FIG. 15 PRIOR ART
FIG. 15 is a schematic drawing of a conventional charge roller.

FIG. 13 illustrates this embodiment of the present invention as the process cartridge.

The charging member in this embodiment is the same as the charge roller 10 in the first experiment described previously. The configuration of the photosensitive drum 40 in this embodiment is also the same as the one in the first experiment.

The development apparatus 111 comprises a development sleeve 112 and a development blade 113. The thickness of the layer of toner 114 borne on the peripheral surface of the development sleeve 112 is controlled by the development blade 113 so that it remains the same at a predetermined thickness. Voltage is applied to the development sleeve 112 from an unillustrated power source to cause the toner on the development sleeve 112 to fly to the photosensitive drum 40. The toner which flies to the photosensitive drum 40 electrostatically adheres to the photosensitive drum 40, developing the electrostatic latent image on the photosensitive drum 40 into a toner image.

The cleaning apparatus 115 is constituted of a cleaning blade 116 and a waste toner container 117. The toner particles which were not transferred during the image formation, and remained on the development sleeve 112 are scraped away from the development sleeve 112 by the cleaning blade 116, and are recovered into the waste toner container 117.

The photosensitive drum 40 and charge roller 10 are integrally assembled into the housing 118 of a process cartridge, along with the developing apparatus 111 and cleaning apparatus 115; it is incorporated into a process cartridge which is removably installable into an unillustrated image forming apparatus.

Also in this process cartridge, an overall pressure of 1400 g is applied to the charge roller 10, with the use of two springs 52 attached, one for one, to the power supply electrode portions 51, that is, the longitudinal end portions, of the supporting member.

This process cartridge was left undisturbed in an environment in which the temperature and humidity were 40° C. and 95%, respectively, for a period of one month. After one month, the photosensitive drum 40 and charge roller 10 had not adhered to each other, and an image formed with the use of these components showed no sign of any specific irregularity.

Further, the process cartridge was left undisturbed until the peripheral surfaces of the charge roller 10 and photosensitive drum 40 were covered with dew from condensation, and the peripheral surfaces of the charge roller 10 and photosensitive drum 40 wet with the dew were placed in contact with each other. Then, the process cartridge was left undisturbed in an environment in which the temperature and humidity were 32.5° C. and 80%. respectively, for a period of two weeks. After two weeks, it was noticeable that a small amount of adhesion had occurred between the charge roller 10 and photosensitive drum 40, but peeling had not occurred. Further, an image formed with the use of this process cartridge showed no sign of any specific irregularity.

While the invention has been described with reference to the structures disclosed herein, it is not confined to the details set forth and this application is intended to cover such modifications or changes as may come within the purposes of the improvements or the scope of the following claims.

What is claimed is:

1. A charging member comprising:

an electroconductive base for being supplied with a voltage;

a first resin layer;

a second resin layer provided on said first resin layer;

wherein said first resin layer and said second resin layer are produced by applying and drying paint-like material comprising resin material dispersed in aqueous material;

wherein a difference in a volume change ratio between the material of said first resin layer and said second resin layer is not more than 2.5% when ambient conditions change from 23° C. and 50% relative humidity to 40° C. and 95% relative humidity.

2. A member according to claim 1, wherein said second resin layer constitutes a surface layer contactable to a member to be charged.

3. A member according to claim 2, wherein said second resin layer comprises fluorine resin material.

4. A member according to claim 3, wherein said first layer comprises acrylic resin material.

5. A member according to claim 3, further comprising an elastic layer between said electroconductive base and said first resin layer.

6. A member according to claim 2, wherein a drying temperature for the second layer is not higher than 120° C.

7. A member according to claim 1, wherein said charging member is in the form of a roller.

8. A member according to claim 1, wherein said first resin layer has a resistance which is lower than that of said second resin layer.

9. An image forming apparatus comprising:

a photosensitive member;

a charging member for contacting a surface of said photosensitive member and electrically charging said photosensitive member; and developing means for developing an electrostatic image formed by image exposure of said photosensitive member having been charged by said charging member, wherein said charging member comprises:

an electroconductive base for being supplied with a voltage;

a first resin layer;

a second resin layer provided on said first resin layer;

wherein said first resin layer and said second resin layer are produced by applying and drying paint-like material comprising resin material dispersed in aqueous material;

wherein a difference in a volume change ratio between the material of said first resin layer and said second resin layer is not more than 2.5% when ambient conditions change from 23° C. and 50% relative humidity to 40° C. and 95% relative humidity.

10. An apparatus according to claim 9, wherein said photosensitive member has an organic photosensitive layer.

11. An apparatus according to claim 9, wherein said photosensitive member and said charging member constitute a process cartridge detachably mountable relative to a main assembly of said image forming apparatus.

12. An apparatus according to claim 9, wherein said second resin layer constitutes a surface layer contactable to said photosensitive member.

13. A member according to claim 12, wherein said second resin layer comprises fluorine resin material.

14. A member according to claim 13, wherein said first layer comprises acrylic resin material.

15. A member according to claim 12, wherein a drying temperature for the second layer is not higher than 120° C.

16. A member according to claim 9, further comprising an elastic layer between said electroconductive base and said first resin layer.

17. A member according to claim 9, wherein the charging member is in the form of a roller.

18. A member according to claim 9, wherein said first resin layer has a resistance which is lower than that of said second resin layer.

* * * * *

UNITED STATES PATENT AND TRADEMARK OFFICE

CERTIFICATE OF CORRECTION

PATENT NO. : 6,219,510 B1
DATED : April 17, 2001
INVENTOR(S) : Ando et al.

It is certified that error appears in the above-identified patent and that said Letters Patent is hereby corrected as shown below:

Column 2,
Line 5, “has” should read -- have --;
Line 20, “above described” should read -- above-described --;
Line 27, “above” should read -- above- --;
Line 35, “is” should read -- be --;
Line 45, “layer 3. The” should read -- layer 3, the --; and
Line 59, “a” should read -- an --.

Column 3,
Line 7, “If” should read -- if --.

Column 4,
Line 33, “ratio” should read -- ratios --;
Line 36, “ration” should read -- ratios --; and
Line 38, “ratio” should read -- ratios --.

Column 5,
Line 39, “above described” should read -- above-described --.

Column 6,
Line 46, “above described” should read -- above-described --.

Column 8,
Line 15, “test.” should read -- tested. --.

Column 9,
Line 37, “above described” should read -- above-described --; and
Line 48, “LATER” should read -- LAYER --.

Column 10,
Line 10, “invention;” should read -- invention, --;
Line 34, “on” should read -- an --; and
Line 48, “and” should read -- had --.

UNITED STATES PATENT AND TRADEMARK OFFICE

CERTIFICATE OF CORRECTION

PATENT NO. : 6,219,510 B1
DATED : April 17, 2001
INVENTOR(S) : Ando et al.

It is certified that error appears in the above-identified patent and that said Letters Patent is hereby corrected as shown below:

Column 11,
Line 42, “80%.” should read -- 80%, --;
Line 57, “layer;” should read -- layer; and --; and
Line 63, “rial;” should read -- rial; and --.

Column 12,
Line 27, “member,” should read -- member; --;
Line 32, “layer;” should read -- layer; and --; and
Line 37, “rial;” should read -- rial; and --.

Signed and Sealed this

Twenty-eighth Day of January, 2003

JAMES E. ROGAN
*Director of the United States Patent and Trademark Office*